United States Patent [19]

Watanabe

[11] Patent Number: 4,814,121

[45] Date of Patent: Mar. 21, 1989

[54] METHOD FOR SPINNING A PETROLEUM-ORIGIN MESOPHASE

[75] Inventor: Masami Watanabe, Tokyo, Japan

[73] Assignee: Kashima Oil Company, Limited, Tokyo, Japan

[21] Appl. No.: 562,132

[22] Filed: Dec. 16, 1983

[30] Foreign Application Priority Data

Mar. 9, 1983 [JP] Japan ..... 58-37310

[51] Int. Cl.[4] ..... D01F 9/12

[52] U.S. Cl. ..... 264/29.2; 264/211.17; 425/461; 423/447.1

[58] Field of Search ..... 264/176 F, 29.2, 105, 264/211.17; 423/447.1, 447.7, 447.6, 447.8; 425/131 S, 463, 464, 461, 72 S

[56] References Cited

U.S. PATENT DOCUMENTS

| | | | |
|---|---|---|---|
| 3,056,163 | 10/1962 | Deis | 425/225 |
| 3,443,899 | 5/1969 | Accountius | 423/447.6 |
| 3,469,280 | 9/1969 | Mott | 425/464 |
| 3,666,847 | 5/1972 | Bailey | 264/108 |
| 3,676,535 | 7/1972 | Juel | 264/108 |
| 3,830,617 | 8/1974 | Coates et al. | 425/464 |
| 3,874,837 | 4/1975 | Jamieson | 425/461 |
| 3,974,264 | 8/1976 | McHenry | 423/447.4 |
| 4,005,183 | 1/1977 | Singer | 423/447.2 |
| 4,026,788 | 5/1977 | McHenry | 423/447.7 |
| 4,056,597 | 11/1977 | Cooper | 425/464 |
| 4,209,500 | 6/1980 | Chwastiak | 423/447 |
| 4,238,538 | 12/1980 | Manwiller | 425/461 |
| 4,248,577 | 2/1981 | Bory et al. | 425/464 |
| 4,303,631 | 12/1981 | Lewis et al. | 423/447.1 |
| 4,317,809 | 3/1982 | Lewis et al. | 423/447.1 |
| 4,376,747 | 3/1983 | Nazem | 264/29.2 |
| 4,504,454 | 3/1985 | Riggs | 264/29.2 |

FOREIGN PATENT DOCUMENTS

| | | | |
|---|---|---|---|
| 0044714 | 1/1982 | European Pat. Off. . | |
| 1299629 | 6/1962 | France . | |
| 1526263 | 5/1968 | France . | |
| 2404666 | 10/1978 | France . | |
| 0068412 | 6/1979 | Japan | 425/463 |
| 58010 | 12/1945 | Netherlands . | |
| 1219110 | 1/1971 | United Kingdom . | |
| 1386679 | 3/1975 | United Kingdom | 264/29.2 |
| 2095222 | 9/1982 | United Kingdom | 264/29.2 |
| 2099845 | 12/1982 | United Kingdom . | |

OTHER PUBLICATIONS

"High Modulus Pitch Based Carbon Fibers", Volk, Union Carbide Corp., 6 pages, 5/1977.

"The Mesophase and High Modulus Carbon Fibers from Pitch", Singer, Carbon, vol. 16, pp. 408–415, 1978.

"Carbon Fibers from Mesophase Pitch", Singer, Fuel, vol. 60, 839–848, Sep. 1981.

"Chemiefasern", Von Zakhar Aleksandrovitsch Rogowin Herausgegeben von Wilhelm Albrecht, New York, 1982, pp. 370–371.

"Carbon and Graphite Fibers", Marshall Sittig, Noyes Data Corporation, Park Ridge, New Jersey, 1980, pp. 130–131, 168–170.

*Primary Examiner*—Jan H. Silbaugh
*Assistant Examiner*—Hubert C. Lorin
*Attorney, Agent, or Firm*—Armstrong, Nikaido, Marmelstein & Kubovcik

[57] ABSTRACT

A method for producing high strength, high modulus filament yarns of carbon fibers is provided by subjecting a mesophase-containing pitch to aging, separating (purifying) the resulting 100% mesophase and subjecting 100% mesophase to melt-spinning at 250° to 350° C. by using spinning nozzles having a greater cross-sectional area in the outlet part than the cross-sectional area in the narrowest inside the nozzles and further to thermosetting and carbonization whereby carbon fibers having a random (shape), turbulent flow shape or rather onion shape of carbon arrangement in cross-section are obtained.

5 Claims, 2 Drawing Sheets

METHOD FOR SPINNING A PETROLEUM-ORIGIN MESOPHASE

BACKGROUND OF THE INVENTION

This invention relates to a method for producing filament yarns of high strength, high modulus carbon fibers. More particularly, it relates to a method for producing filament yarns of high strength, high modulus carbon fibers by specifying raw materials and spinning condition.

As the result of recent rapid growth of industries for manufacturing aircrafts, motor vehicles and other transport, a demand for materials prepared by a combination of special materials as a material necessary to these industries capable of exhibiting remarkable characteristics because of the superiority of some of their physical properties is ever increasing. Particularly, the demand for the advent of inexpensive materials provided with high strength and high modulus together with lightness of weight is great. However, since the material which satisfies the above-mentioned demand cannot be supplied in a stabilized manner according to the present status of art, research works relative to composite articles (reinforced resins) which meet the above-mentioned requirement are prevailing.

As one of the most promising material to be used as reinforced resin, there can be mentioned high strength, high modulus carbon fibers. These materials have appeared from about the time when the rapid growth of the above-mentioned industry just started. When the carbon fibers are combined with a resin, it is possible to produce reinforced resins capable of exhibiting characteristic feature unparalleled in the past. To be regretful enough, however, in spite of the high strength and high modulus of the carbon fibers for the above-mentioned reinforced resins capable of exhibiting extremely notable characteristic feature, the application fields of these fibers have not expanded. The cause of this fact, as explained later, lies in the higher production cost.

It is well known that the materials for high strength, high modulus carbon fibers which are commercially available are mostly polyacrylonitrile fibers produced by a special production process and a special spinning process but these acrylonitrile fibers are not only expensive as a precursor of carbon fibers but also the production yield thereof from the precursor is as low as less than 45%. These facts complicate the treatment steps and enlarge production facilities for producing superior carbon fibers, resulting in the increasing production cost of the ultimate products of carbon fibers. The production cost of high strength, high modulus carbon fibers of the ultimate product is further increased by the treatment cost, etc. of hydrocyanic acid by-produced at the time of carbonization treatment.

As for one method for producing high strength, high modulus carbon fibers at a low cost, there are descriptions in the official gazette of Japanese patent publication No. 1810 (1979) issued to Union Carbide Corporation and it is a well known fact that mesophase-containing pitches are extremely superior raw material as raw materials for filament yarns of high strength high modulus carbon fibers. For pitches as raw materials of high strength, high modulus carbon fibers, the content of mesophase and the physical properties of mesophase itself naturally give large influence upon the physical properties of carbon fibers. The higher the mesophase content and the better the quality of mesophase, the greater the improvement of the physical properties of carbon fibers.

However, the carbon fibers produced from a 100% mesophase, as a raw material, through a melt-spinning process by using nozzles having a circular cross-section, followed by the steps of thermosetting and carbonization, show radial arrangement of carbon in the cross-section of carbon fibers and create cracks. Thus the resultant carbon fibers have little value as articles of commerce.

Accordingly, it is an object of the present invention to provide a method for producing high strength, high modulus carbon fibers having no drawbacks of conventional carbon fibers prepared according to conventional technique as above-mentioned but having sufficient value as articles of commerce.

SUMMARY OF THE INVENTION

The above-mentioned object can be attained by the method of the present invention. According to the method of the present invention, a mesophase-containing pitch (which is determined by a polarization microscope) is made from a raw material of petroleum-origin pitch such as those which are produced as by-products of carbonaceous material of catalytic cracking process (FCC) of vacuum gas oil by heat treatment. The resulting mesophase-containing pitch is subjected to aging to cause only mesophase to melt and coalesce, and 100% mesophase is separated (purified). After the purification, the 100% mesophase is then subjected to melt spinning (by) using spinning nozzles having a greater cross-sectional area of nozzle outlet than the cross-sectional area of the narrowest part inside the nozzles and at a spinning temperature in the range of 250° C. to 350° C. and the resultant filament yarns are further subjected to thermosetting and carbonization to obtain high strength, high modulus filament yarns having a random shape (or turbulent flow shape) or onion shape structure in the arrangement of carbon in the cross-section.

The inventor of the present application has discovered after comprehensive studies that carbon fibers having no crack can be obtained (as shown in FIG. 2) by making the arrangement of carbon in the cross-section of carbon fibers (as observed by SEM), made of 100% mesophase, (easily confirmed by polarization microscope) so as to take random shape (turbulent flow shape) or onion shape (structure obtained by cutting it in round slices) and that when carbon fibers are made of a high quality 100% mesophase pitch as a raw material, physical properties of carbon fibers, particularly strength tend to increase. As a method for making the arrangement of carbon in the cross-section of carbon fibers (as observed by a scanning electron microscope-SEM) so as to take random shape, it has been found that melt spinning of a 100% mesophase, carried out at a spinning temperature of 250°~350° C. by using spinning nozzles (as shown in FIG. 1) having a greater outlet cross-section than the narrowest cross-section of nozzle inside, followed by thermosetting and carbonization provides particularly higher strength (more than 330 kg/mm$^2$ in strength), higher modulus (more than 75 /mm$^2$ in modulus of elasticity) filaments of carbon fibers having a random shape in the carbon arrangement of cross-section but having no crack at all can be produced.

DETAILED DESCRIPTION OF THE INVENTION

Detailed description will be given as to the above-mentioned spinning temperature. According to the result of experiment, when spinning temperature is reduced to lower than 250° C., the viscosity of 100% mesophase as raw material for spinning is so increased that spinning property becomes worse, resulting in difficulty of spinning. On the other hand, when spinning temperature is higher than 350° C., the viscosity of 100% mesophase as raw material for spinning is so lowered that breakage of spun filaments occurs frequently. Accordingly, the spinning temperature for 100% mesophase a raw material for spinning will be proper when it is in the range of 250° C. to 350° C.

One example of the shapes of spining nozzles accomodated in the spinnerette in a spinning machine used in the method of the present invention will be described but it is offered by way of illustration and not by way of limitation.

Figure 1:
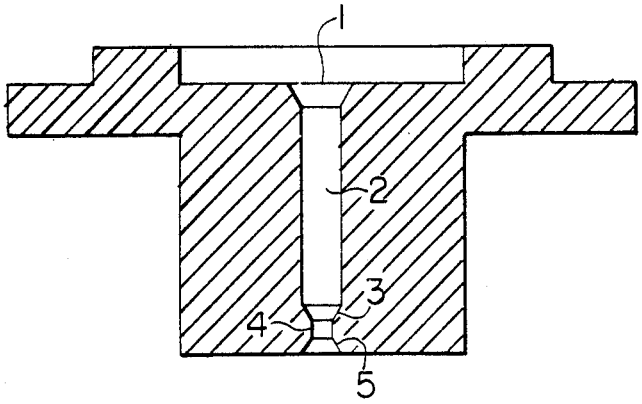
Figure 2:
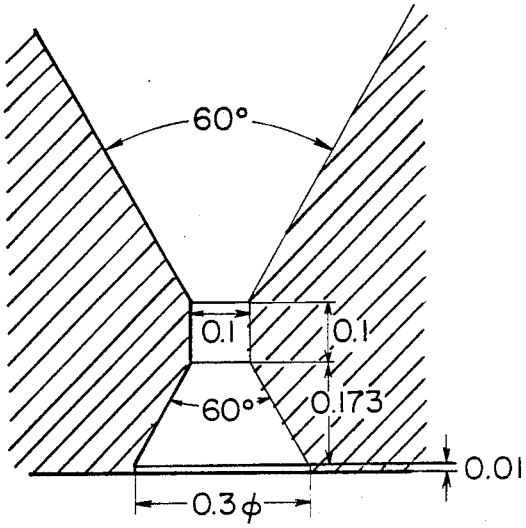
Figure 3:
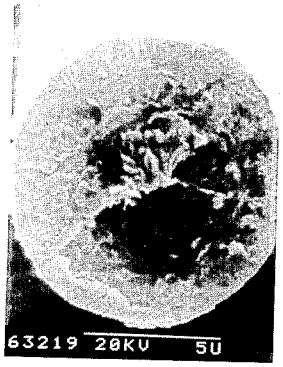
Figure 4:
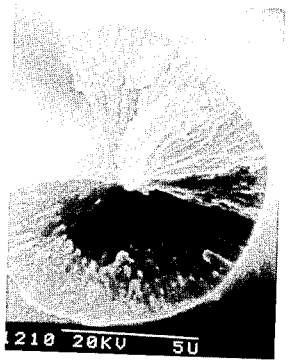

In the accompanying drawings, FIG. 1 is a sketch of a cross-section passing through the center of a spinning nozzle used in the method of the present invention; FIG. 2 is a sketch of the detail of the outlet part of the same nozzle; FIG. 3 is a cross-section of carbon fibers having a random structure prepared according to the method of the present invention (observed by SEM); and FIG. 4 is a cross-section of carbon fibers prepared according to the method of referential example of the present invention hereinafter described.

In FIG. 1, 1 is an inlet of a nozzle, 2 is a cylindrical part of the nozzle hole, 3 is a truncated circular cone part which follows the nozzle hole 2 and converges at a conical angle of 60°, 4 is a cylindrical part which follows the nozzle hole 3 and 5 is an outlet in a truncated circular cone shape which follows the nozzle hole 4 and is enlarged at a conical angle of 60°.

However, in the method of the present invention, on account of the shape and size of nozzles as shown in the FIG. 1, and the use of a 100% mesophase as a raw material pitch for producing carbon fibers, the orientation of carbon is nice. thus if a melt-spinning is carried out by using a spinning nozzle of a circular cross-section, the arrangement of carbon of carbon fibers takes a radial shape. However, by using spinning nozzles having an outlet cross-sectional area greater than the cross-sectional area at the narrowest part of the nozzle inside and a cross-sectional shape which provides turbulent action to the flow of 100% mesophase, it is possible to make the arrangement of carbon take a random shape or rather an onion shape (structure of onion cut in round slices).

A 100% mesophase, as a raw material for producing carbon fibers is produced by subjecting distillate fractions (an initial fraction is from 404° C to 409° C.) of a petroleum pitch which is a residual carbonacious material produced as a by-product of catalytic cracking process (F.C.C.) of vacuum gas oil, to heat-treatment at a temperature of 360° C. to 420° C. by using a carrier gas of a hydrocarbon gas of low carbon numbers to produce a mesophase-containing pitch, then treating the resulting mesophase-containing pitch at an aging condition entirely different from that of mesophase formation, for a long time to melt and coalesce only mesophase and separating (purifying) the 100% mesophase by utilizing the difference of physical properties at the aging temperature.

The invention entitled "method for producing mesophase-containing pitch by using a carrier gas" filed by Masami Watanabe on June 24, 1983 (U.S. Ser. No. 507,585), now U.S. Pat. No. 4,487,685. and "Improved method for producing mesophase pitch" filed also by Masami Watanabe on June 24, 1983 (U.S. Ser. No. 507586), now U.S. Pat. No. 4,529,499 have been utilized partly in the present invention. and the descriptions of these inventions are incorporated in the description of the present application by reference.

Following examples are offered by way of illustration and not by way of limitation.

EXAMPLE 1

Distillate fractions of petroleum pitch of residual carbonecious material produced as a by-product of catalytic cracking of vacuum gas oil (F.C.C.) (an initial fraction of 404° C and a final fraction of 560° C. or lower) was subjected to heat treatment at a temperature of 400° C. for 2 hours while sending methane gas therein, then to aging of mesophase at a temperature of 320° C. for 10 hours, causing very fine inorganic solid matter of the catalyst for thermal cracking, and large-molecular weight organic material present in the petroleum-origin pitch in the form of a mixture to be included in the mesophase, subjecting the pitch purified by separating such impurity containing part, to heat treatment at a heating temperature of 400° C. for 6 hours to produce a pitch containing 45.2% mesophase, then to aging treatment, separating 100% mesophase by the difference of viscosity (mesophase shows 108 poise and nonmesophase 10 poise at a temperature of 308° C.). By using the 100% mesophase thus obtained, as a raw material, and a spinning nozzle shown in FIG. 1, spinning was carried out at a spinning temperature of 303° C. and a take-up velocity of 280 m/min. The resultant raw filament yarns were subjected to thermosetting at 300° C. and then calcination at 2800° C. to effect graphite-carbonization to produce high strength and high modulus filament yarns of carbon fibers having a random form arrangement of carbon in the cross-section thereof, a strength of 332 kg/mm$^2$, a modulus of elasticity of 75.4 /mm$^2$, and an elongation of 0.44% but containing no crack at all.

REFERENTIAL EXAMPLE

The carbon fibers produced from the 100% mesophase made according to the method of Example 1 by using a spinning nozzle having a non-enlarged outlet of 0.3 mm inside diameter in its circular cross-section and the spinning condition, thermosetting condition, calcination condition and graphite-carbonization of Example 1 showed a radial shape in the arrangement of carbon in the cross-section of the carbon fibers and created cracks of about 90° in angle. The product had no value as articles of commerce.

What is claimed is:

1. A method for producing high strength, high modulus filament yarns of carbon fibers essentially free of cracks and having a random shape, turbulent flow shape or onion shape of carbon arrangement in cross-section which comprises: preparing a mesophase-containing pitch from a petroleum-origin pitch; subjecting the pitch to aging so as to melt and coalesce only the mesophase therein; separating the 100% mesophase; melt spinning the separated 100% mesophase at a spinning temperature of 250° C. to 350° C. by using a spinning nozzle having a greater cross-sectional areas in the outlet part than the cross-sectional area in the narrowest inside thereof, the narrowest inside of the nozzle being located upstream relative to the outlet part; and thermosetting and carbonizing the spun 100% mesophase.

2. A method according to claim 1, wherein the spinning nozzle commprises an inner truncated circular cone converging towards the narrowest inside of the spinning nozzle, and the greater cross-sectional area in the outlet part of the spinning nozzle is formed from an outer portion of an outer truncated circular cone.

3. A method according to claim 1, wherein the narrowest inside of the spinning nozzle is a hollow cylinder with each end thereof connected to narrowest portions of hollow truncated circular cones, one of the cones forming the outer part of the spinning nozzle having a greater cross-sectional area than the cross-sectional area of the narrowest inside of the spinning nozzle.

4. A method according to claim 3, wherein the truncated circular cones converge at an angle at 60°, the hollow cylinder making up the narrowest inside of the spinning nozzle has a diameter and length both of 0.1 mm, and the cone forming the outer part of the spinning nozzle has a length of 0.173 mm.

5. A method according to claim 4, wherein the cone forming the outer part of the spinning nozzle has an end thereof, opposite the narrowest inside of the spinning nozzle, connected to a hollow cylinder having a diameter of 0.3 mm and a length of 0.01 mm

* * * * *